United States Patent [19]

Allen, Jr.

[11] 4,235,392

[45] Nov. 25, 1980

[54] TEXTILE BOBBIN

[75] Inventor: Frank L. Allen, Jr., Hopedale, Mass.

[73] Assignee: Rockwell International Corporation, Pittsburgh, Pa.

[21] Appl. No.: 42,850

[22] Filed: May 29, 1979

[51] Int. Cl.[3] ..... B65H 75/12; B32B 27/40; B05D 3/02

[52] U.S. Cl. ..... 242/118.32; 427/393; 428/425.1; 428/541; 428/537

[58] Field of Search ..... 427/393; 428/423, 511, 428/514, 537, 425, 541; 242/118.32

[56] References Cited

U.S. PATENT DOCUMENTS

| | | | |
|---|---|---|---|
| 3,577,271 | 5/1971 | Bliven et al. | 242/118.32 X |
| 3,664,861 | 5/1972 | Okamura et al. | 428/425 X |
| 3,681,289 | 8/1972 | Kruse et al. | 428/423 X |
| 4,006,866 | 2/1977 | Webster et al. | 427/407 X |
| 4,054,690 | 10/1977 | Webster et al. | 427/408 X |

*Primary Examiner*—Michael R. Lusignan

[57] ABSTRACT

An improved wood textile bobbin having a single protective wear resistant coating, the coating when applied having the ability to rapidly form a tack free outer surface and cure to a desirable working surface over woods or wood grains that have been previously unusable, wherein the composition for the coating is made up of from about 40 to 65 percent solids consisting of a ricinoleic acid/diphenylmethane diisocyanate prepolymer (MDI) and a moisture activated, blocked, hydroxyl functional acrylic resin, the balance being a solvent in which the solids are dissolved for the purpose of applying the composition to the outer surface of the bobbin substrate.

5 Claims, No Drawings

TEXTILE BOBBIN

BACKGROUND OF THE INVENTION

The surface of a weaving bobbin which comes into contact with the yarn that is wound around it must be extremely smooth so that the yarn will not be caught and broken during the weaving process. In addition to being smooth, the surface of the bobbin must also be wear resistant since many of the yarns used in modern weaving technology are extremely abrasive. Wood bobbins are normally produced by cutting blocks of wood to an initial rough size and then mechanically reducing the bobbin blank to its ultimate desired dimension, as by turning or the like. Due to the inherent shortcomings of the mechanical shaping operation, only clear, straight grained wood could be used in the production of bobbins. Thus, forming woods or grains such as curly, bird's-eye, etc., or heartwood would result in surface imperfections that could only be made useful through the application of a multiplicity of surface coats. It was not possible to provide an adequate surface finish, whether a varnish or an enamel, with the application of a single layer of protective material. Although it is known to apply surface finishes containing from about 20 to 25 percent solids, this being the maximum heretofore permissible, it has not been possible to apply surface coating of acceptable viscosity, which contained the percentage of solids necessary to impart surface protection to the bobbin with a single application.

Surface finishes other than varnish or enamel that have a high solids content have been tried but they are not suitable as a bobbin finish due to the lack of hardness, tackiness, solid yarn withdrawal characteristics or they require curing conditions that are incompatible with wood or wood bobbins.

SUMMARY OF THE INVENTION

It is a principle object of this invention to provide an improved wood bobbin that is coated with a composition which permits the application of a single protective wear resistant, high solids content coating on the wear surfaces of the bobbin.

Another object of this invention is to provide an improved wood bobbin that is coated with a composition which can provide a protective surface on the bobbin when it is made of previously unacceptably grained woods or types of woods with the application of a single layer of material.

Another object of this invention is to provide an improved composition for application to the surface of wood bobbins which contains from about 40 to 65 percent solids, (including a ricinoleic acid/diphenylmethane diisocyanate prepolymer), and balance a solvent which contains no OH group or water.

Another object of this invention is to provide an improved bobbin having a protective wear resistant coating formed from the coating composition of this invention which will become tack free in substantially less time than known types of protective coatings for bobbins.

Other objects and advantages of this invention will be in part obvious and in part explained by reference to the accompanying specification.

DESCRIPTION OF THE PREFERRED EMBODIMENT

As indicated above, bobbins suitable for use in the textile industry must have hard, wear resistant surfaces which are free of imperfections or flaws that would cause the yarn to catch and be broken during the weaving operation. Bobbins have been constructed completely of synthetic materials, which are suitable for some applications where high density is no problem, but probably the most widespread construction material for bobbins has been wood. The wood bobbins, both to improve their abrasion resistance and to provide a smooth defect-free surface, have been coated with a variety of protective materials. These materials have taken the form of both single and multiple layer coatings. Generally, it is preferred that coating materials consist of only one layer since the application of multiple layers is more expensive and somewhat less certain due to problems relating to inter-laminar adhesion problems. Exemplifying some of the approaches effected in the areas of bobbin coating are those described in U.S. Pat. Nos. 4,006,866 and 4,054,690.

The present invention is based upon the reaction products of hydroxyl-functional acrylic resin, where the reactive hydroxyl groups are blocked, but can be moisture activated, and a ricinoleic/diphenylmethane diisocyanate prepolymer. The NCO/OH ratio can vary from 1/1 to 5/1, depending upon the desired hardness of the resultant finish. The total solids can vary from about 42 to 65 percent. All percentages stated in this description will be in weight percent, unless otherwise indicated. For purposes of applying the coating forming materials to the underlying substrate, they are dissolved in a suitable solvent. The type of solvent used is not critical, except that the solvent can contain no hydroxyl (OH) group or any water which would upset the ratio between the hydroxyl functional acrylic resin and the MID prepolymer. The quantity of solvent used in preparing the coating material is a function of the viscosity desired as well as the drying rate that may be desired. Obviously, if the coating material is to be applied by spraying, then the viscosity of the solution must be less than would be the case if the coating were to be applied by dipping. Further, the viscosity should be such that the coating material gels under proper temperature and humidity conditions in approximately one minute After application, that is becomes tack free, so that the solvents will be released from the material as quickly as possible for complete drying of the coating.

The following tables set forth specific compositions which have been found to be particularly efficacious in developing uniform wear resistant single layer protective coatings on wood bobbins made of woods that would have been heretofore not useable other than with the application of multiple coatings or the like.

TABLE I

| NCO/OH RATIO | 42% SOLIDS MDI[a] | OH[b] | SOLVENT[c] |
|---|---|---|---|
| 1/1 | 200 | 270 | 699 |
| 5/1 | 1000 | 270 | 1753 |

[a]MDI added as "Vorite" - a product of Baker Oil Co.
[b]OH added as "Acryloid AU568" - a product of Rohm & Haas Co.
[c]added as xylene and ethylene glycol monoethyl ether acetate in equal proportions with respect to each other.

TABLE II

| NCO/OH RATIO | MDI[a] | OH[b] | SOLVENT[c] |
|---|---|---|---|
| | 50% SOLIDS | | |
| 1/1 | 200 | 270 | 470 |
| 5/1 | 1000 | 270 | 1270 |

[a]MDI added as "Vorite" - a product of Baker Oil Co.
[b]OH added as "Acryloid AU568" - a product of Rohm & Haas Co.
[c]added as xylene and ethylene glycol monoethyl ether acetate in equal proportions with respect to each other.

TABLE III

| NCO/OH RATIO | MDI[a] | OH[b] | SOLVENT[c] |
|---|---|---|---|
| | 65% SOLIDS | | |
| 1/1 | 200 | 270 | 253 |
| 5/1 | 100 | 270 | 684 |

[a]MDI added as "Vorite" - a product of Baker Oil Co.
[b]OH added as "Acryloid AU568" - a product of Rohm & Haas Co.
[c]added as xylene and ethylene glycol monoethyl ether acetate in equal proportions with respect to each other.

Although the present invention has been described in connection with a preferred embodiment, it should be understood that modifications and variations may be resorted to without departing from the spirit and scope of the invention as those skilled in the art will readily understand. Such modifications and variations are considered to be within the purview and scope of the appended claims.

I claim:

1. An improved wood textile bobbin having a single protective wear resistant coating that rapidly forms a tack free surface upon application which is formed from a coating composition consisting essentially of by weight percent:

(a) about 40 to 65 percent solids consisting of;
  (i) a ricinoleic acid/diphenylmethane diisocyanate prepolymer (MDI); and
  (ii) a moisture activated, blocked, hydroxyl functional acrylic resin; and
(b) balance a solvent for the solids of (a) which solvent contains no hydroxide group or water.

2. An improved bobbin as defined in claim 1 wherein the coating composition has a ratio of MDI to hydroxyl functional acrylic resin ranging from about 1:1 to 5:1.

3. An improved bobbin as defined in claim 2 wherein the percent of solids present in said coating composition ranges from about 42 to 50 percent.

4. An improved bobbin as defined in claim 2 wherein the solvent used in the composition consists essentially of xylene and ethylene glycol monoethyl ether acetate.

5. An improved bobbin as defined in claim 4 wherein the xylene and the ethylene glycol monoethyl ether acetate are present in equal proportions with respect to each other.

* * * * *